US005171198A

United States Patent [19]

Jones

[11] Patent Number: 5,171,198

[45] Date of Patent: Dec. 15, 1992

[54] LATERAL RAISE EXERCISE MACHINE

[75] Inventor: Gary A. Jones, Falmouth, Ky.

[73] Assignee: Hammer Strength Corporation, Cincinnati, Ohio

[21] Appl. No.: 621,053

[22] Filed: Nov. 30, 1990

[51] Int. Cl.[5] ..... A63B 21/00

[52] U.S. Cl. ..... 482/97; 482/92; 482/133

[58] Field of Search ..... 272/130, 131, 134, 136, 272/118, 117, 116, 144, 900, 93

[56] References Cited

U.S. PATENT DOCUMENTS 3,858,873 1/1975 Jones .
3,998,454 12/1976 Jones .
4,720,099 1/1988 Carlson .
4,854,578 8/1989 Fulks ..... 272/117

OTHER PUBLICATIONS

Instruction Manual by Nautilus, p. 12.
High Intensity Strength Training Equipment, *The Nautilus Book*, pp. 151 & 153.
Cybex Marketing brochure—p. 4—Lateral Raise Titled Cybex Strength Systems Dec. 1989.
Nautilus Instruction Manual; Catalog Digest; Jun. 14, 1979; pp. 29 and 39.

*Primary Examiner*—Richard J. Apley
*Assistant Examiner*—Jerome Donnelly
*Attorney, Agent, or Firm*—Wood, Herron & Evans

[57] ABSTRACT

A lateral raise exercise machine includes a frame, a seat and backrest supported by the frame along a vertical midplane and two levers pivotally connected to the frame on opposite sides of the midplane behind the seat and backrest. Each lever includes a hub adapted to hold at least one removable weight, a counterweight mounted opposite the pivot point from the hub, a connector that extends forwardly alongside the backrest and seat, and an actuating pad mounted at a forward end of the connector. The levers pivot about axes that converge forwardly toward the vertical midplane. With the forearms engaging inner surfaces of the actuating pads, an exerciser supported on the seat and backrest may pivotally raise the levers upwardly against the weight supported on the hubs via a lateral shoulder abductive motion, thereby to exercise the deltoid muscles.

13 Claims, 4 Drawing Sheets

LATERAL RAISE EXERCISE MACHINE

FIELD OF THE INVENTION

This invention relates to a lateral raise exercise machine.

BACKGROUND OF THE INVENTION

Among both athletes and non-athletes, the popularity of weight training exercise has substantially increased in the past ten years. In addition to the use of traditional "free weights," i.e., plate-loaded barbells or dumbbells, weight training exercises are also performed with a number of specialized exercise machines that work a particular muscle group through a prescribed motion or exercise maneuver. Generally, for most exercise maneuvers that may be performed either on a machine or with free weights, exercise machines tend to be safer. Moreover, from a practical standpoint, certain exercise maneuvers are simply more efficient and beneficial when performed on an exercise machine, particularly when the major purpose for performing weight training is to rehabilitate an injured limb.

In addition to rehabilitation, another purpose of weight training is the prevention of injuries. By building up the muscles associated with a particular movement and the joints involved with that movement, the likelihood of injury can be reduced.

The deltoid muscles on the tops of the shoulders are exercised during a movement referred to as lateral shoulder abduction. An exerciser may exercise the deltoid muscles by grasping dumbbells in each hand and laterally raising them upwardly through a lateral shoulder abduction movement, with the arms bent or extended at the elbows. However, it is difficult to perform this exercise with dumbbells in a steady, controlled manner. Rather, the movement is somewhat jerky, and if the exerciser is using too much weight, this manner of performing this exercise may cause injury. Optimally, to maximize muscular benefit to the deltoid muscles, steady lateral abductive movement through a relatively large range of motion is desirable. The above-described dumbbell exercise does not provide either steady movement or movement through an extended range of motion.

One known lateral raise exercise machine addresses some of the disadvantages associated with the use of dumbbells to exercise the deltoid muscles through a lateral shoulder abduction. This method locates the exerciser in a seated position, with graspable handles located on opposite sides of the seat. The handles are connected to arms which extend forwardly from rotatable eccentric cams located behind the seat. The cams rotate in a vertical plane that is perpendicular to the forward facing direction of the seat. Each cam is connected to a chain, with one end of each chain adapted to ride around the respective cam and an opposite end of each chain connected to a selectable number of stacked weight plates.

By engaging the outer portions of the forearms against inwardly directed surfaces of pads mounted on the insides of the extenders, and then grasping the handles located forwardly of these pads, an exerciser supported on the seat laterally raises the arms in a lateral shoulder abduction to exercise the deltoid muscles. With this machine, the exerciser is able to work the deltoid muscles in a smooth manner through a relatively large range of lateral shoulder abductive motion.

Nevertheless, this exercise machine suffers from a number of disadvantages. First, from a practical standpoint, the rotatable cams and chains require maintenance, as outlined in applicant's copending patent application Ser. Nos. 514,869 and 514,839. Otherwise, undesired friction builds up and adds to the weight resistance that must be moved by the exerciser during the exercise. Second, the machine itself is relatively expensive. For some exercise facilities, the benefits of this machine may not justify its costs. Third, although this exercise machine does allow separate exercise of the deltoid muscle on either side of the body, this manner of single side exercise is inconvenient because it requires disconnection of one of the cams from the weight stack and a change to a lesser weight. Fourth, this lateral raise exercise machine does not seem to quite "fit" the actual musculoskeletal make-up of a human being when performing a lateral shoulder abduction movement. For many exercisers, the plane of lateral movement causes some impingement of the shoulder joint, and as a result, use of this exercise machine may feel awkward or uncomfortable.

It is an object of this invention to provide an improved lateral raise exercise machine.

It is another object of this invention to provide the lateral raise exercise machine which, compared to a prior lateral raise exercise machine, is relatively inexpensive and more naturally accommodates the musculoskeletal make-up of a human being.

It is still another object of the invention to provide a lateral raise exercise machine that is equally suitable for convenient simultaneous exercise of both deltoid muscles or alternate exercise of one deltoid muscle at a time.

SUMMARY OF THE INVENTION

To these ends, a lateral raise exercise machine includes a frame, a seat and backrest connected to the frame and a pair of independently pivotal levers connected to the frame on opposite sides of the seat and backrest. The levers are upwardly pivotal through a lateral shoulder abductive motion by an exerciser supported on the seat, with the pivot axes of the levers converging with respect to the forward facing direction of the seat and and tilting downwardly toward the seat backrest. The levers move through planes that are perpendicular to the forwardly converging and downwardly tilting pivot axes, so that the levers move through planes of motion that also angle forwardly and tilt downwardly.

This lateral raise exercise machine enables an exerciser to perform lateral shoulder abduction against a selectable weight resistance in a steady manner, through a relatively large range of motion, thereby maximizing the muscular benefit to the deltoid muscles. Moreover, the structural orientation of the machine components provide natural positioning for coupling an applied lateral raising force to angled planes of motion.

According to a preferred embodiment of the invention, this lateral raise exercise machine includes a frame, a seat and backrest connected to the frame and bisected by a vertical midplane, and two levers pivotally connected to the frame on opposite sides of the midplane behind the seat and backrest. The levers pivot along axes that converge with respect to the forward facing direction of the seat and backrest. Each lever includes a hub adapted to hold at least one removable weight, a counterweight located opposite of the pivot point from the hub, a connector that extends forwardly from the lever alongside the seat and an actuating pad secured to an inside surface of the connector. The connector extends forwardly at a downwardly tilting angle. An inwardly directed surface of the actuating pad is adapted to be acted upon by the outside portion of a forearm of an exerciser supported on the seat and backrest during lateral shoulder abduction. With this machine, the exerciser is able to exercise the deltoid muscles without experiencing the shoulder joint impingement generally associated with one known, prior lateral raise exercise machine.

After placing a selectable number of weight plates on the hubs, the exerciser sits on the seat and leans back against the backrest. With the outer portions of the forearms contacting the inside surfaces of the pads, the exerciser pivotally raises the levers upwardly and outwardly against the weight supported by the hubs through a lateral shoulder abductive motion. This lateral raise exercise may be performed for both sides of the body simultaneously, alternately with both sides of the body or simply one side of the body at a time, without requiring a changing of weight.

Additionally, the deltoid muscles on one side of the body may be exercised with relatively low weight, a feature that is particularly advantageous during rehabilitation because it facilitates comparison of relative strength between the right and left deltoid muscles. Moreover, for each lever, the counterweight counterbalances the weight of the hub, the connector and the actuating pad. Therefore, without any weight plates held on the hub, the weight resistance felt by the exerciser during movement of the levers is very low. This feature is also advantageous for rehabilitation because it enables the exerciser to exercise a deltoid muscle against an extremely low weight resistance and to accurately measure progress or recovery of a deltoid muscle through small incremental increases in weight resistance.

The structural orientation of the individual components of this lateral raise exercise machine are particularly designed to more naturally accommodate the musculoskeletal make-up of the human body during exercise of the deltoid muscles through a lateral raise motion or lateral shoulder abductive motion. The levers are pivotally connected to the frame such that their pivot axes are non-parallel with a vertical midplane through the center of the frame and seat. Rather, the axes of pivotal motion converge forwardly and tilt downwardly with respect to the declining seat. The levers move through planes that are perpendicular with the converging axes.

The particular structural orientation of the components of this lateral raise exercise machine was arrived at by applicant after many years of observation and experience in exercise and weight training facilities across the United States, coupled with his knowledge, experience and observation of the musculoskeletal movements of athletes during performance. Applicant observed that, while most athletic movements involve compound angles or movement of multiple joints through three dimensional space, almost all exercise machines are designed specifically for movement of the limbs through restricted planes or at angles that are generally oriented 90° with respect to the torso, or with respect to the joints involved.

For many individuals, use of these machines produced unnecessary joint stress, due to the imposed restrictions in degrees of freedom of movement. In short, many individuals felt "confined" in these machines. While applicant believed that exercise machines of this type could prove somewhat beneficial to athletes in strengthening the limbs, he also concluded that exercise machines more suited to the actual musculoskeletal make-up of the human body would provide optimum muscular benefit if more natural bodily movements were simulated. With this premise, applicant set out to improve upon prior exercise machines. Based upon feedback from a number of individuals who lift weights to maintain peak physical condition to compete in professional sports, applicant has succeeded in achieving this goal for a variety of weight training exercise machines. This lateral raise exercise machine represents one of these successes.

These and other features of the invention will be more readily understood in view of the following detailed description and the drawings.

DETAILED DESCRIPTION OF THE DRAWINGS

Figure 1:
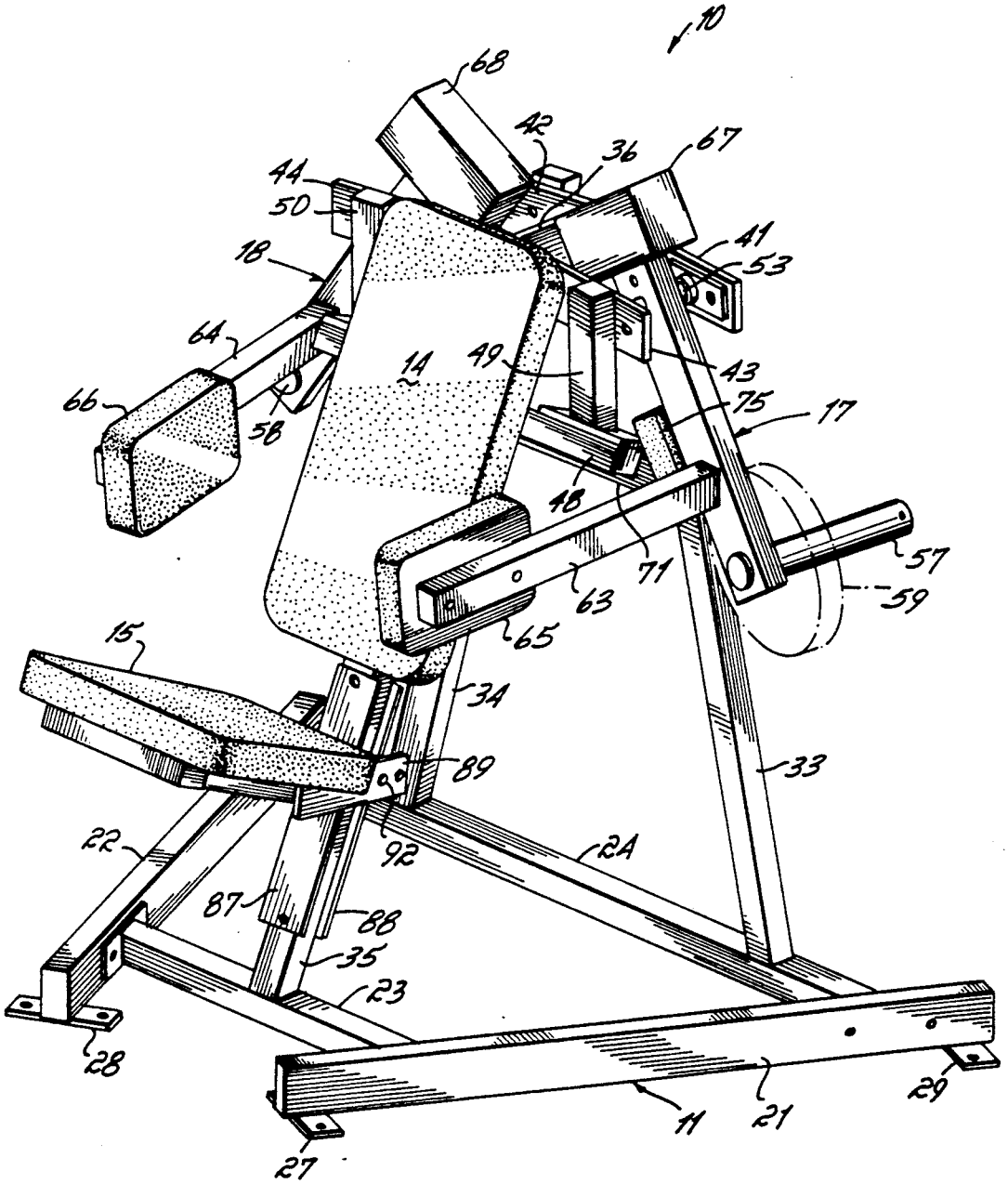
FIG. 1 is a perspective view of a lateral raise exercise machine in accordance with a preferred embodiment of the invention.

FIGS. 1–4 show a lateral raise exercise machine 10 in accordance with a preferred embodiment of the invention. The machine 10 includes a frame 11 of metal parts either connected together by nut and bolt connections or welds. The frame 11 includes a backrest 14, a seat 15, and pivotal levers 17 and 18 which are pivotally connected to the frame 11 and located behind the backrest 14. The frame 11 is supported by bottom side sections 21 and 22 which are interconnected with front and back bottom sections 23 and 24, respectively. At the corners of the frame 11, side section 21 is supported by plates 27 and 29, and side section 22 is supported by plates 28 and 30.

Legs 33 and 34 have bottom ends welded to back bottom section 24. Legs extend upwardly at an angle, with their top ends nearer to each other than the bottom ends. A center leg 35 is welded at its bottom end to front and bottom section 23. The upper end of center leg 35 is supported by center plate 36. Center plate 36 is supported by rear plates 41 and 42 which are connected to the upper ends of legs 33 and 34, respectively. The forward portion of center plate 36 supports weights 43 and 44, which are parallel to, and in spaced relationship with plates 41 and 42, respectively. A brace 48 is welded in horizontal disposition to the rear surface of center leg 35, and spaced uprights 49 and 50 extend upwardly from opposite sides of brace 48 to connect with plates 43 and 44, respectively.

The orientation of plates 41 and 43 dictate the axis of pivotal motion of an axle 53 rigidly connected to lever 17. Similarly, on the opposite side of the frame 11, the orientation of plates 42 and 44 (FIG. 4) dictate the axis of pivotal motion of an axle 54 that is rigidly connected to lever 18. Interconnection between each pair of plates and its respective axle is made with bearings sized to the outer diameter of the axles. A pillow block bearing sold by Browning, Part No. VF 2S 116 has proved suitable. These bearings require maintenance only once a year, which consists of one shot of lubricating oil. Hub 57 is connected at a right angle to an outer end of axle 17 and is adapted to hold at least one removable weight plate 59 (shown in phantom). The number of such plates, and the weight of the plates determines the weight resistance the exerciser must move during performance of a lateral raise exercise. The lever 17 also includes a connector 63 which extends forwardly alongside the seat 15 to support an actuating pad 65 that is acted upon by the exerciser (not shown) during performance of a lateral raise. An inner end of lever 17 includes a counterweight 67 which substantially counterbalances the weight of the hub 57, the connector 63 and the pad 65 when no weighted plates 59 are held. Similarly, lever 18 includes a hub 58 for holding one or more weighted plates (not shown), a forwardly extending connector 64, an actuating pad 66 supported at the forward end of the connector 64 and a counterweight 68. For each lever, the connector and the actuating pad serve as an actuating means for performing a lateral raise exercise.

Figure 2:
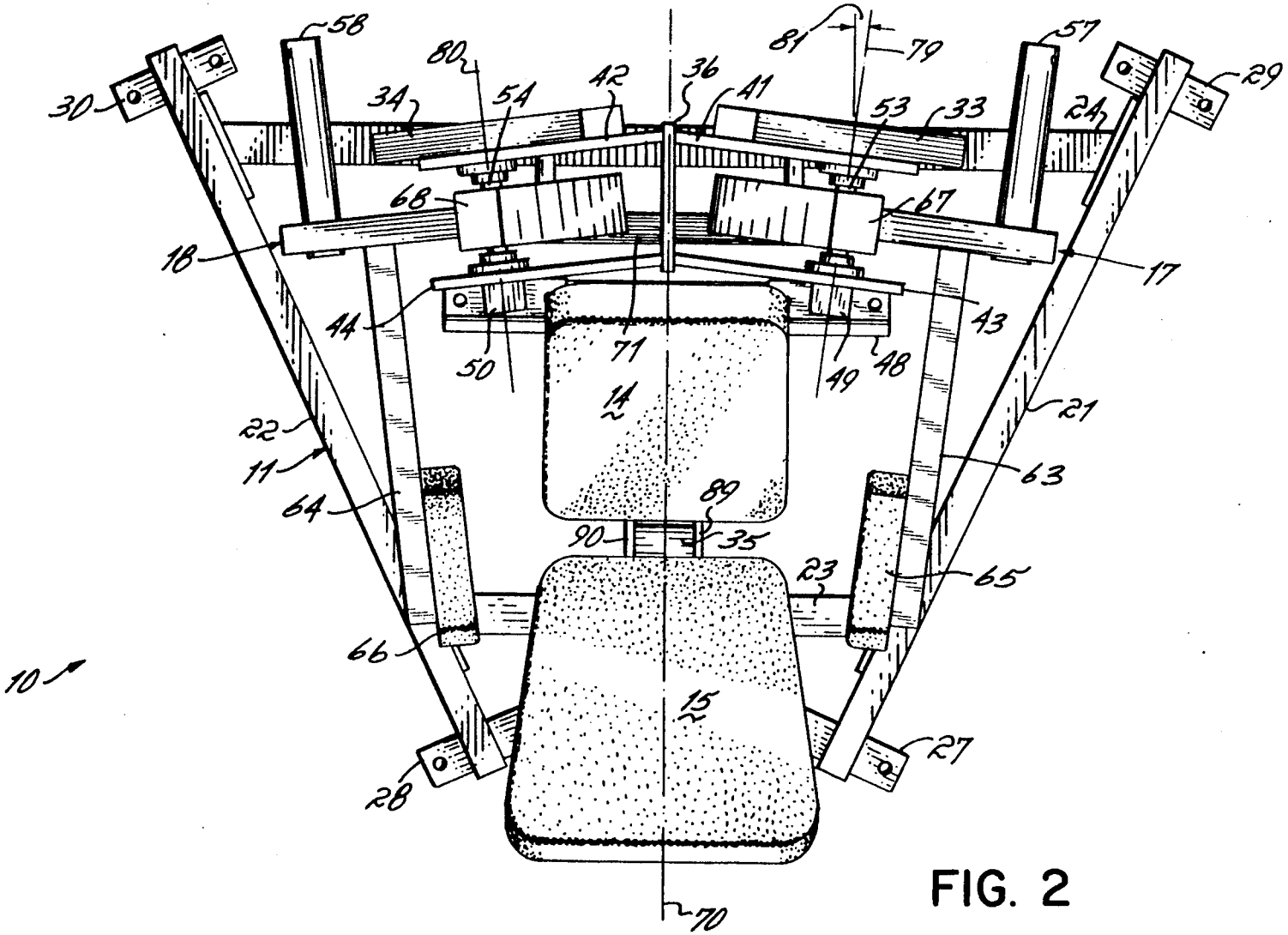
FIG. 2 is a top plan view of the lateral raise exercise machine shown in FIG. 1.
Figure 4:
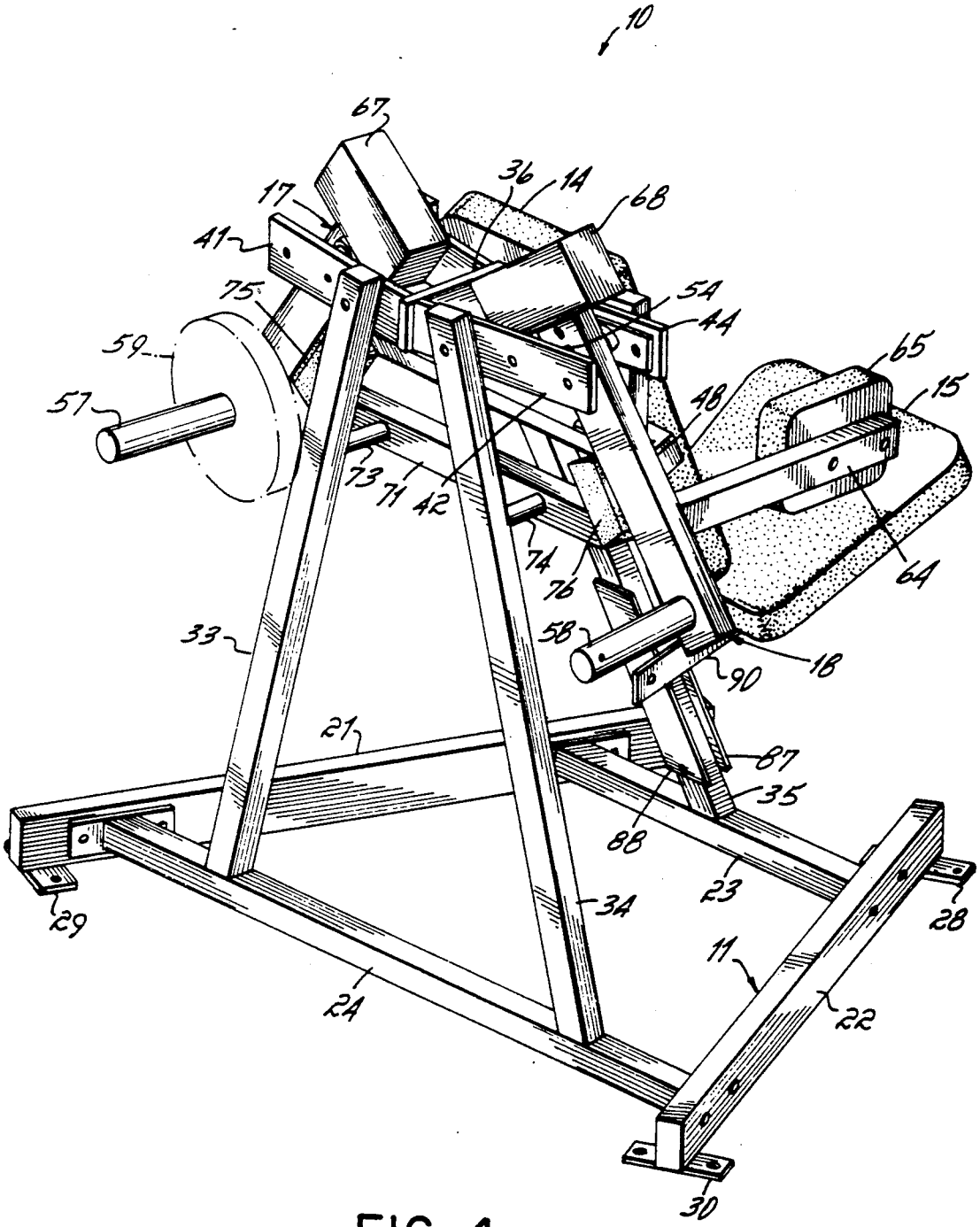
FIG. 4 is a perspective view, shown from the back, of the lateral raise exercise machine shown in FIG. 1.

As shown in FIG. 2, frame 11 is symmetric with respect to vertical midplane 70 through the center of the machine 10. FIG. 2 also shows a rearward brace 71 that extends between legs 33 and 34. As best depicted in FIG. 4, the rearward brace 71 is connected to legs 33 and 34 by horizontally oriented rods 73 and 74, respectively. The ends of rearward brace 71 include rubber stops or bumpers 75 and 76. The stops 75 and 76 limit downward movement of levers 17 and 18, respectively.

FIG. 2 also shows the axes of pivotal movement of the levers, i.e., axis 79 for lever 17 and axis 80 for lever 18, each of which is non-parallel with the vertical midplane 70. These axes converge forwardly and tilt downwardly with respect to frame 11. This angle of forward convergence is designated by numeral 81 and is preferably about 8°.

Figure 3:
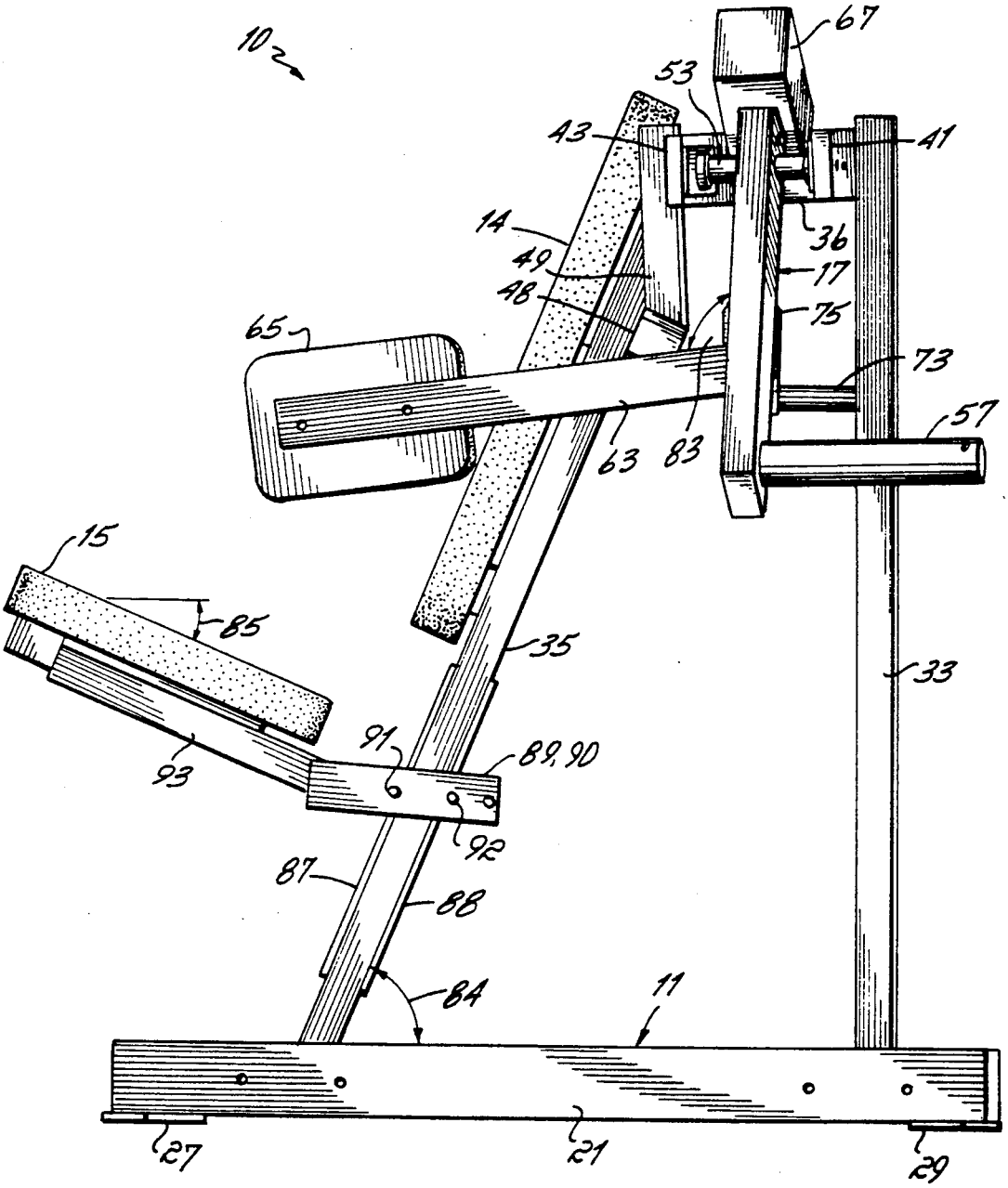
FIG. 3 is a side view of the lateral raise exercise machine shown in FIG. 1.

FIG. 3 shows a side view of the frame 11. As shown in the figure, connector 63 extends forwardly from the lever 17 at an angle designated by numeral 83, an angle which is preferably about 100°, or about 20° downward from horizontal. Legs 33 and 34 also tilt downwardly about 2° toward the front of the frame 11, or toward the bottom side sections 21 and 22. Numeral 95 designates the angle between bottom side section 21 and leg 33, an angle which is preferably about 88°. Because the plates 41 and 43 are parallel with leg 33, and because axle 53 is perpendicular with plates 41 and 43, axle 53 also tilts downwardly from horizontal at an angle of about 2°, an angle designated by numeral 96. The converging angle 81 and tilting angle 96 of the lever 17, along with the downward tilt of connector 63 toward the front of the frame 11 locates the actuating pad 65 in a more natural position for an exerciser supported on the seat 15 and backrest 14. Similarly, on the opposite side of the frame 11, though not shown, leg 34 and plates 42 and 44 also tilt downwardly at the same angles. Thus, for each side of the frame 11, the orientation of the pivot axis provides a natural position for coupling an applied lateral raise force to a forwardly and downwardly angled plane of motion. Numeral 84 designates the angle between center leg 35 and the bottom sections of frame 11. Preferably, this angle is about 70°. Numeral 85 designates the rearward tilt from horizontal of seat 15. Preferably this angle of rearward tilt is about 25°.

Preferably, seat 15 is adjustable along leg 35. Adjustability is provided by mounting resilient, parallel members 87 and 88 on forward and rear portions, respectively, of leg 35. Parallel, spaced seat supports 89 and 90 are interconnected by parallel rods 91 and 92 which abut against and frictionally engage the outer surfaces of members 87 and 88, respectively, to maintain seat 15 in a selected position with respect to leg 35. Seat 15 is rigidly connected to a base 93 that is connected to seat supports 89 and 90.

In order to move seat 15 upwardly or downwardly with respect to center leg 35, a forward edge of seat 15 is lifted upwardly to provide clearance between rods 91 and 92 and members 87 and 88, respectively. With the forward edge held up in this manner, the seat 15 may be moved along center leg 35 to a desired location. When the forward edge of seat 15 is released, gravity will cause the seat 15 to rotate slightly in a forward direction until rods 91 and 92 frictionally engage plates members 87 and 88, respectively.

While I have described a preferred embodiment of this invention, it is to be understood that the invention is not limited thereby and that in light of the present disclosure of the invention, various other alternative embodiments will be apparent to a person skilled in the art. For instance, the structural orientation of some parts of the frame 11 is not critical, so long as the locations of the seat and backrest with respect to the positions of the levers and lever pivot axes angles are maintained. Additionally, while the particular angles shown are considered to be optimum at this point in time, based upon feedback from those involved in strength training, it is entirely possible that some further refinements may evolve. Accordingly, it is to be understood that changes may be made without departing from the scope of the invention as particularly set forth and claimed.

I claim:

1. A lateral raise exercise machine comprising:

a frame;

a set and backrest supported by the frame and bisected by a vertical midplane, the seat adapted to support an exerciser positioned in a forward facing direction;

a lever pivotally connected to the frame behind the backrest and above the seat on one side of the vertical midplane, a lower end of the lever adapted to hold at least one removable weight; and actuating means extending forwardly from the lower end of the lever and alongside the seat and backrest and adapted to be acted upon by the arm of an exercise supported on the seat and backrest to pivotally raise the lever through a lateral shoulder abductive motion to exercise a deltoid muscle, wherein the pivot axis of the lever converges toward the vertical midplane of the frame with respect to the forward facing direction of the seat and backrest, the lever being pivotal through a plane which is oriented at an angle of less than 90° with respect to the midplane.

2. The lateral raise exercise machine of claim 1 wherein the angle of convergence of the lever pivot axis is about 8°.

3. The lateral raise exercise machine of claim 1 and further comprising:

another lever and actuating means located on an opposite side of the vertical midplane and symmetric with the first lever and first actuating means with respect to the vertical midplane.

4. The lateral raise exercise machine of claim 1 wherein the lever pivots about an axis that tilts forwardly and downwardly toward the seat and backrest.

5. A lateral raise exercise machine comprising:

a frame;

a seat and backrest supported by the frame and bisected by a vertical midplane;

a lever pivotally connected to the frame behind the backrest on one side of the vertical midplane, one end of the lever adapted to hold at least one removable weight a predetermined distance from the midplane; and actuating means connected to the lever between the midplane and said one end, the actuating means extending forwardly from the level alongside the seat and backrest and adapted to be acted upon by the arm of an exerciser supported on the seat and backrest to pivotally raise the lever through a lateral shoulder abductive motion to exercise a deltoid muscle, the lever pivotal about an axis to move the at least one removable weight through a plane of motion which is neither parallel with nor perpendicular to the vertical midplane, wherein the actuating means extends forwardly from the lever at a downwardly tilting angle.

6. The lateral raise exercise machine of claim 5 wherein the downwardly tilting angle is about 20°.

7. A lateral raise exercise machine comprising:

a frame;

a seat and backrest supported by the frame and facing in a forward direction along a vertical midplane through the frame;

two levers pivotally connected to the frame behind the backrest and above the seat on opposite sides of the midplane, each lever having a lower end adapted to hold at least one removable weight; and two actuating means, each actuating means located on one side of the midplane and connected to the lower end of the respective lever and adapted to be acted upon by the forearm of an exerciser supported on the seat and backrest to pivotally raise the respective lever through a lateral shoulder abductive motion to exercise a deltoid muscle, wherein the pivot axes of the levers converge toward the vertical midplane of the frame with respect to the forward facing direction of seat and backrest and each of the levers pivots through a plane of motion which is oriented at an angle of less than 90° with respect to the midplane.

8. A rear deltoid exercise machine of claim 7 wherein each lever pivot axis converges at an angle of about 8°.

9. The lateral raise exercise machine or claim 7 wherein each actuating means further comprises:

a connector extending forwardly from a respective lever; and an actuating pad mounted at a forward end of the connector, the actuating pad adapted to be acted against by the exerciser to pivotally raise the respective lever.

10. The lateral raise exercise machine of claim 7 wherein each lever pivots about an axis that tilts forwardly and downwardly toward the seat and backrest.

11. A lateral raise exercise machine comprising:

a frame;

a seat and backrest supported by the frame and facing in a forward direction;

two levers pivotally connected to the frame on opposite sides of the seat and backrest, each lever having one end adapted to hold at least one removable weight;

two actuating means, each actuating means connected to a lever and adapted to be acted upon by the forearm of an exerciser supported on the seat and backrest to pivotally raise the respective lever through a lateral shoulder abductive motion to exercise a deltoid muscle, the levers being pivotal about axes that converge with respect to the forward facing direction of the seat and the backrest, wherein each actuating means further comprises, a connector extending forwardly from a respective lever; and an actuating pad mounted at a forward end of the connector, the actuating pad adapted to be acted against by the exerciser to pivotally raise the respective lever, wherein each connector extends forwardly and tilts downwardly from a respective lever.

12. The lateral raise exercise machine of claim 1 wherein each connector tilts downwardly at an angle of about 20°.

13. The lateral raise exercise machine of claim 11 wherein each pivot axis tilts forwardly and downwardly toward the seat and backrest.

* * * * *